US005558105A

United States Patent [19]

Rosenwinkel et al.

[11] Patent Number: 5,558,105

[45] Date of Patent: Sep. 24, 1996

[54] HAIR BEADING TOOL

[75] Inventors: Donald Rosenwinkel, Oak Park, Ill.; Mark Reyner, Oelwein, Iowa

[73] Assignee: Breslow, Morrison, Terzian & Associates, Inc., Chicago, Ill.

[21] Appl. No.: 386,453

[22] Filed: Feb. 10, 1995

[51] Int. Cl.[6] ..... A45D 7/02

[52] U.S. Cl. ..... 132/212; 132/207; 132/200

[58] Field of Search ..... 132/207, 212, 132/200, 273; 446/394; 139/380; 66/117, 1 A, 118

[56] References Cited

U.S. PATENT DOCUMENTS

| | | | |
|---|---|---|---|
| 602,699 | 4/1898 | Davis . | |
| 1,327,918 | 1/1920 | Kelsey . | |
| 1,682,985 | 9/1928 | Rollins . | |
| 1,709,631 | 4/1929 | Schmidt . | |
| 2,063,918 | 12/1936 | Flood . | |
| 2,064,826 | 12/1936 | Gabriel . | |
| 2,624,098 | 1/1953 | Isley | 139/380 |
| 2,924,228 | 2/1960 | McGee . | |
| 3,035,817 | 5/1962 | Wilson . | |
| 3,133,345 | 5/1964 | Shaw . | |
| 3,196,064 | 7/1965 | Tell . | |
| 3,227,121 | 1/1966 | Speetjens et al. . | |
| 3,450,140 | 6/1969 | Vail . | |
| 3,545,069 | 12/1970 | Krieger . | |
| 4,315,362 | 2/1982 | Pigford et al. . | |
| 4,381,021 | 4/1983 | Gunneman | 139/380 |
| 4,551,899 | 11/1985 | Castillo . | |
| 4,603,560 | 8/1986 | Pietrowski | 66/1 R |
| 5,404,892 | 4/1995 | Bretl | 132/212 |

FOREIGN PATENT DOCUMENTS

| | | |
|---|---|---|
| 2390118 | 12/1978 | France . |

OTHER PUBLICATIONS

Physical speciman of Twist 'n Style Tiffany Doll and Hair Decorating Tool by Hasbro, Inc.

*Primary Examiner*—Nicholas D. Lucchesi
*Assistant Examiner*—Pedro Philogene
*Attorney, Agent, or Firm*—Dick and Harris

[57] ABSTRACT

A hair beading tool has a handle, a spindle joined to the handle, and a string joined to the spindle. A resilient bead is slid over both the spindle and string and other beads follow. A loop is formed in the string through which a lock of hair or clothing is inserted. With the loop drawn tight around the hair, the beads are pushed off of the spindle and string and onto the hair with the resilient bead last to bind the hair and restrain other beads from sliding off.

6 Claims, 1 Drawing Sheet

10
12
14
16
18
20
30
32
34
36
40
42
44
46
50
52
54
58
59
60

HAIR BEADING TOOL

This invention relates generally to a method and tool for attaching beads to hair and clothing for adornment, and specifically to a tool having a handle, spindle, and string that are manipulated by the user to receive and dispense beads onto a lock of hair or a portion of clothing.

BACKGROUND OF THE INVENTION

A hair beading tool permits easy application of beads to locks of hair. One such tool is disclosed in Pigford et al., U.S. Pat. No. 4,315,362 which includes a handle, a piece of bent wire cord coated with plastic and having both ends joined to the handle to define a thin loop. Beads are strung onto the bent wire cord far enough to leave an opening through which a braid of hair is inserted. Then beads are pushed off the wire cord and onto the braid where they remain, apparently, because the braid thickness is larger than the opening in the beads and the braid tends to expand to hold the beads on the hair.

The *Pigford et al.* hair beading tool is relatively expensive to make because it uses plastic coated resilient wire cord. Further, it must be used with a hair lock thickness greater than the size of the opening in the bead so that the beads do not fall off. It therefore, requires a strong push to force the beads off of the wire cord onto the lock of hair, as well as, a certain amount of dexterity in retaining the hair in the loop while pushing the beads off of the cord. Thus, there is a need for an inexpensive, simply constructed hair beading tool that is easy for a child to use.

SUMMARY OF THE INVENTION

The present invention includes several simple elements that are inexpensive and easy to use to quickly apply a multiple of beads to the doll or child's hair without the beads falling off the hair after the tool is drawn away.

A hair beading tool in accordance with the present invention includes a handle, a spindle joined to the handle, and a string is joined to a free end of the spindle. The string includes a free end that is pulled back and held to the handle so that the string is adjacent the spindle and beads can slide over both to be supported on the spindle. A portion of the string is then pulled away from the handle to form a loop at the end of the spindle through which a lock of hair is pulled. To hold the hair securely, the string's second end is pulled tightly back toward the handle, and the beads are easily pushed off onto the hair.

A resilient bead is the first bead pushed over the spindle and string, and is the last bead pushed onto the hair. This permits the use of additional beads that have openings larger than the lock of hair on which they are applied for ease of dispensing the beads. The last resilient bead is easily stretched and secured to the hair to keep the other large beads on the lock of hair.

The tool may also include a hook joined to the bottom of the handle, extending downward and rearward to define a slot in which the string is held securely while the beading operation is conducted. The string may be unable to slip through the slot when a plastic stop is secured to the free end of the string and it is too large to fit through the slot. This feature makes it easier for a child to quickly master the tool.

DETAILED DESCRIPTION OF THE DRAWINGS

Figures 1, 2, 3, 4:
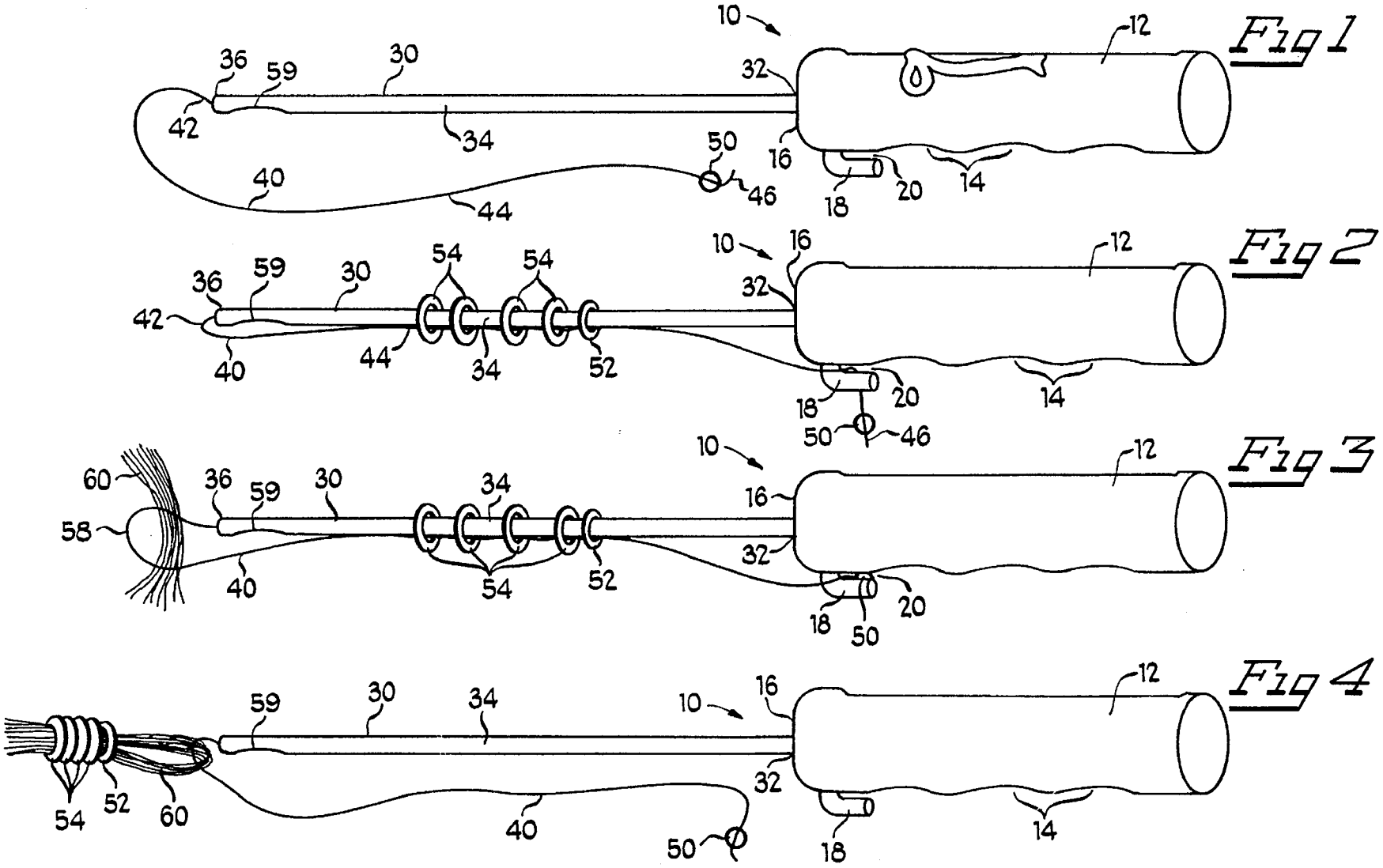
FIG. 1 is a perspective view of a doll hair beading tool having a handle, a spindle, and a string in accordance with the present invention.
FIG. 2 is the hair beading tool of FIG. 1 with beads threaded over the spindle and string.
FIG. 3 is the hair beading tool of FIG. 1 with a lock of hair in a loop formed by the string.
FIG. 4 is the hair beading tool of FIG. 1 after the beads have been dispensed onto the lock of hair.

To the extent reasonable and practical, the same reference characters will be used to identify the same elements depicted in each of the figures. Illustrated in FIG. 1 is a hair beading tool 10, in accordance with the present invention. The hair beading tool 10 includes a handle 12 made of molded ABS with finger grooves 14 along its lower edge. Other comfort features or designs also may be molded with the handle 12. The handle 12 also includes a front end 16 that has a hook 18 extending downward and rearward to define a slot 20 with the handle 12. The hook 18 may be glued to the handle 12 within a recess (not illustrated) to keep the connecting joint within the handle 12 for to conceal sharp burrs or edges and for a smooth appearance.

Connected or molded integrally with the front end 16 of the handle 12 is a long and narrow spindle 30. The spindle 30 is smooth to reduce friction and it includes a first end 32 joined to the handle 12, a central elongated portion 34, and a second free end 36.

The string 40 has a first end 42 that is glued, clamped or tied to the spindle's free end 36. The string 40 also includes a central portion 44, and a second free end 46. A plastic stop 50 is glued, tied, or molded permanently around the second free end of the string 40.

The operation of the hair beading tool 10 is illustrated in FIGS. 2 through 4. Initially, the string 40 is pulled back along the spindle 30 and wrapped into the slot 20 defined by the hook 18. The open rear end of the slot 20 is closed by the user's finger and the string 40 is trapped because the stop 50 is larger than the slot 20 and cannot be pulled through.

Alternatively, the stop 50 can be inserted into a key hole in the handle 12, which has a large opening for receiving the stop 50 and a recess into which the stop 50 slides. The recess has a slot through which the string 40 slides, but is too small for the stop 50 to fall out. With this embodiment the string 40 is retained back against the spindle 30 as with the hook 18.

Next, the user slips a resilient bead 52 over the spindle and the string 40 and toward the handle 12. The resilient bead 52 is preferably made of soft, elastic pvc. It may have an opening that is slightly smaller than the lock of hair, clothing fringe, or shoe lace etc., to which it will be applied one that or at least is smaller than the hair or fringe doubled over. If desired, additional beads 54 are added, except they have larger openings that need not and preferably do not fit tightly on the spindle or the lock of hair on which they will be applied.

With the desired number of beads positioned on the spindle 30 and string 40, the string 40 is pulled forward along the spindle 30 away from the handle 12 to form a loop 58 (FIG. 3) at the end of the spindle 30 which is large enough to receive a lock of doll's hair 60 or a fringe of clothing on which the beads are to be applied. When a large number of beads are on the spindle 30, the string 40 may become quite tight against the spindle 30. Therefore, it may be desirable to include a finger depression 59 in the spindle 30, over which the string 30 will be stretched for easy grasping by the user when it is desired to form the loop 58.

Next, the free end of the string 46 or the stop 50 is pulled to draw the loop 58 tight around the hair 60 to secure it adjacent the end of the spindle 36. The large beads 54 are then easily slipped onto the hair 60 because of their openings are relatively large. With the large beads 54 in place, the resilient bead 52 is then pushed off the spindle 30 and onto the lock of hair 60. The resilient bead 52 stretches to accommodate the size of the lock of hair 60 or the lock of hair doubled over as depicted in FIG. 4. In this manner, the resilient bead 52 grasps the hair 60 and stays at the point where it is pushed to serve as an adornment and to retain the larger loose-fitting beads 54 that were previously strung on the hair. Similarly, all of the beads may be pushed onto the lock of hair 60 with one motion by simply pushing on the resilient bead 52 while the others 54 are still on the spindle 30.

At this stage, there are no beads remaining on the spindle 30, and the loop 58 is no longer tight around the hair so it falls away leaving the beads in place or is pulled through the hair loop as depicted in FIG. 4.

It is to be understood that the lock of hair in the above description can be replaced by a fringe on articles of the doll's clothing such as shoe laces etc. and that no other unnecessary limitations should be understood from the description.

We claim:

1. A hair beading tool comprising:

a handle;

a spindle having a first end joined to the handle and a second, free end;

a string having a first end joined to the free end of the spindle and a second, free end; and a hook joined to the handle and defining a slot therewith for receiving the string.

2. The hair beading tool of claim 1, and further comprising:

a stop joined to the free end of the string and sized to prevent the string from pulling completely through the slot.

3. The hair beading tool of claim 1, and further comprising:

a resilient first bead defining an opening for receiving a lock of hair, the resilient bead having means for binding the lock of hair and restraining any other beads previously pushed onto the same lock of hair from falling off.

4. The hair beading tool of claim 1:

in which the spindle defines a depression, over which the string spans when beads are positioned on the spindle.

5. A method for applying beads to a lock of hair using a hair beading tool having a handle, a spindle joined to the handle, a string joined to the end of the spindle and a hook joined to the handle to define a slot therewith, the method comprising the steps of:

pulling the string into the slot to bring a portion of the string adjacent the spindle;

sliding beads onto the spindle and string;

pulling on a portion of the string to define a loop near the free end of the spindle;

inserting a lock of hair in the loop;

pulling the free end of the string to draw the loop tightly around the lock of hair; and sliding the beads off of the spindle and string and onto the lock of hair.

6. The method of claim 5 and further comprising the steps of:

sliding a resilient bead onto the spindle before any others; and sliding the resilient bead onto the lock of hair to secure both the resilient bead and any other previously dispensed beads to the lock of hair.

* * * * *